United States Patent [19]

Patterson

[11] Patent Number: 5,076,131

[45] Date of Patent: Dec. 31, 1991

[54] PORTABLE AND MOBILE ELECTRONIC PERCUSSION MUSIC SYSTEM

[76] Inventor: Matthew T. Patterson, 6413 W. 80th Pl., Westchester, Calif. 90045

[21] Appl. No.: 515,045

[22] Filed: Apr. 26, 1990

[51] Int. Cl.[5] ..... G10H 1/00

[52] U.S. Cl. ..... 84/421; 84/DIG. 3; 84/412

[58] Field of Search ..... 84/702, 718, 730, 327, 84/421, DIG. 7

[56] References Cited

U.S. PATENT DOCUMENTS 3,774,823 11/1973 Hoellerich ..... 84/421

4,043,241 8/1977 Liu ..... 84/DIG. 7

*Primary Examiner*—William M. Shoop, Jr.

*Assistant Examiner*—Helen Kim

*Attorney, Agent, or Firm*—Irell & Manella

[57] ABSTRACT

A portable and mobile electronic percussion music system includes a plurality of electronic percussion trigger pads, a processing and control panel, a separable and adjustable supporting frame for supporting the trigger pads and/or the processing and control panel and a separable and adjustable player carrier harness for carrying the supporting frame. The music system further includes a portable and mobile cymbal assembly. The present music system can bring about more comprehensive and enjoyable percussion music and visual effects in a moving performance and is convenient for travel and transportation.

28 Claims, 3 Drawing Sheets

FIG. 1.
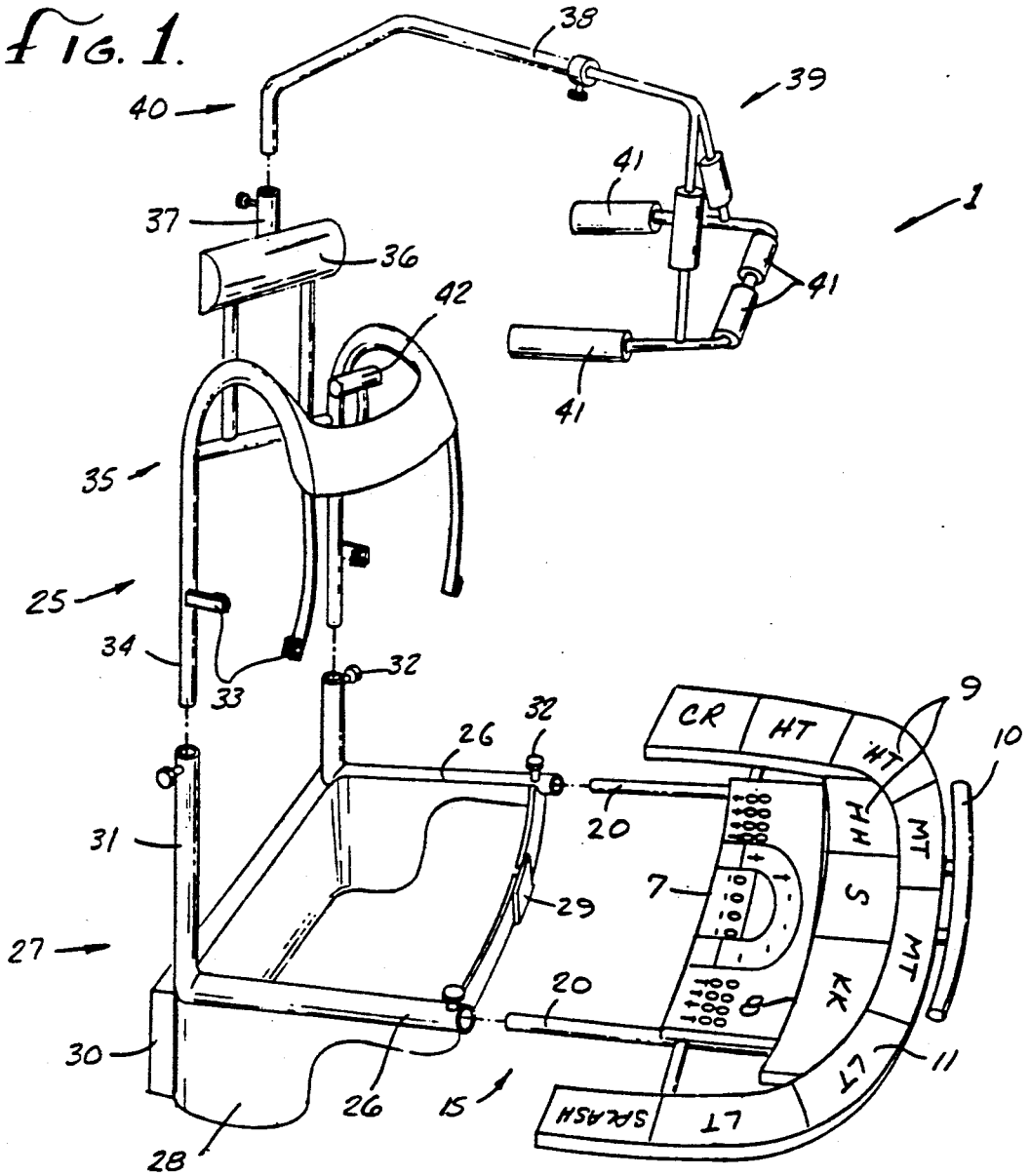
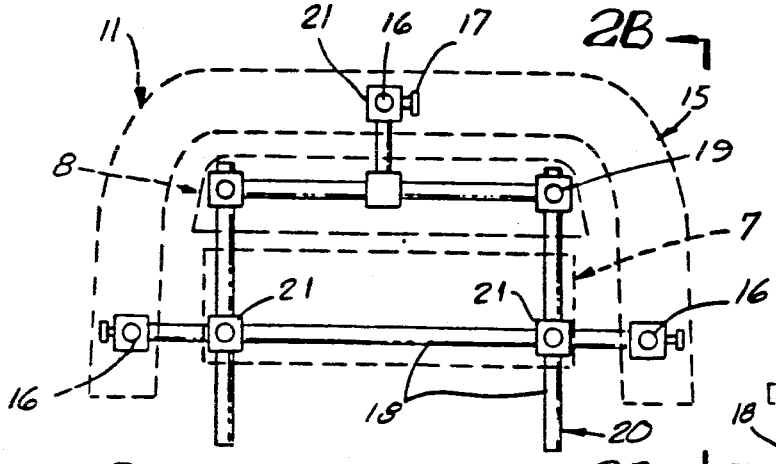
FIG. 2A.
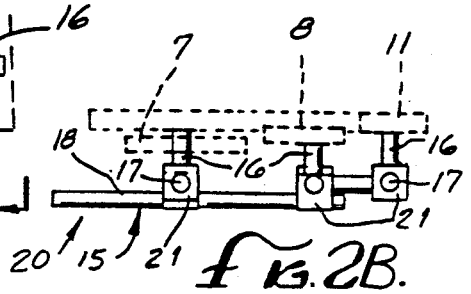
FIG. 2B.

PORTABLE AND MOBILE ELECTRONIC PERCUSSION MUSIC SYSTEM

BACKGROUND OF THE INVENTION

The present invention relates to a portable and mobile music system, and particularly to a portable and mobile electronic percussion music system.

In recent years, many new electronic music instruments have been developed. These devices are generally categorized as music synthesizers. Some electronic percussion synthesizers have been used to develop percussion rhythms as replacements for conventional percussion instruments. Such electronic synthesizers are disclosed, for example, in U.S. Pat. No. 4,479,412 issued on Oct. 30, 1984 to Scott S. Klynas and U.S. Pat. No. 4,781,097 issued on Nov. 1, 1988 to Shigeru Uchiyama. However, such previous electronic percussion music apparatus can only be used in a stationary mode during a performance and are not suitable for a mobile and comprehensive performance.

In order to make a drum instrument carryable for a marching drummer, some drum carriers for carrying conventional drums are disclosed in the prior art, such as by U.S. Pat. No. 4,256,007 issued on Mar. 17, 1981 to James L. Streit, U.S. Pat. No. 4,387,839 issued on June 14, 1983 to John S. Dranchak, U.S. Pat. No. 4,402,441 issued on Sept. 6, 1983 to Russell S. Jones and U.S. Pat. No. 3,974,732 issued on Aug. 17, 1976 to Ralph C. Kester. These prior carriers do not well satisfy the requirements for carrying a relatively heavy and much more complicated electronic percussion music system.

A portable and mobile electronic drum system is shown by U.S. Pat. No. 4,753,146 issued on June 28, 1988 to Brock Seiler. This system includes some percussion transducers fastened directly on the performer's body, a stationary synthesizer and a wireless radio transmitter used to communicate signals between the percussion transducers and the synthesizer. However, this system can only present a simple performance because of its structures and would be awkward for a percussionist to use.

Clearly, performance and visual effects are very much restricted by the conventional stationary percussion music system or the conventional mobile electronic drum system. The present invention discloses a novel portable and mobile percussion music system which can be used by a performer or musician to present more comprehensive and enjoyable performances.

OBJECT OF THE INVENTION

It is an object of the present invention to provide a portable and mobile electronic percussion music system which can be used to play different percussion rhythms by a player in a moving or mobile performance.

It is another object of the present invention to provide a portable and mobile electronic percussion music system which can be separated into parts so that it is convenient for travel and transportation.

It is still another object of the present invention to provide a portable and mobile electronic percussion music system which can be used to present comprehensive and complicated music performances.

It is still another object of the present invention to provide a portable and mobile electronic percussion music system, including a plurality of various percussion trigger devices for producing different music electronic signals which are arranged in such a way that is convenient for the player to strike each of the percussion triggers during moving performances and present better visual effects to the audience.

It is still another object of the present invention to provide a portable and mobile electronic percussion music system which can be adjusted to satisfy the requirements of different performers.

It is a further object of the present invention to provide a portable and mobile electronic percussion music system, including position adjustment elements for adjusting the position of the percussion trigger devices with respect to the player.

These and still further objects of the present invention will become apparent hereinafter.

BRIEF SUMMARY OF THE INVENTION

The present invention relates to a novel portable and mobile electronic percussion music system. The percussion music system includes a plurality of electronic percussion trigger pads, a processing and control panel, at least a housing for holding the trigger pads in place, a separable and adjustable supporting frame for supporting the processing and control panel and the housing, and a separable and adjustable player carrier harness for carrying the supporting frame.

In a preferred embodiment, the flexible housing extended in a U-shape. The supporting frame is comprised of horizontal and vertical bars or tubes which include complementary connection portions for cooperative engagement to each other and adjustment elements for adjusting the height and length of the supporting frame. The player carrier harness includes a shoulder portion and a waist portion which can be separated or adjustably connected to each other so that the distance between the two portions can be adjusted according to a specific player. The processing and control panel includes an interface section, processing section, memory section, control section having percussion trigger and rhythm selection buttons or keys and display members for displaying the control status, and a wireless transmitter for transmitting sound output signals to a receiver coupled to an amplifier or a P.A. system.

In another preferred embodiment, instead of holding trigger pads in a flexible housing, each of the trigger pads may be separately disposed at different positions and heights by adjustable supporting members, according to the particular habits of a performer. The supporting members are either connectable with the supporting frame or integrally formed with the supporting frame.

The percussion music system may further include a cymbal assembly disposed above the player's head and supported by a cymbal supporting frame for adding additional music and visual effects in the performance.

BRIEF DESCRIPTION OF THE DRAWING

FIG. 1 is a perspective view of an embodiment of the portable and mobile electronic percussion music system of the present invention.

FIGS. 2A and 2B, respectively, show a top view and a side view of an embodiment of the supporting frame of the portable and mobile electronic percussion music system.

DETAILED DESCRIPTION OF THE INVENTION

Figure 3A:
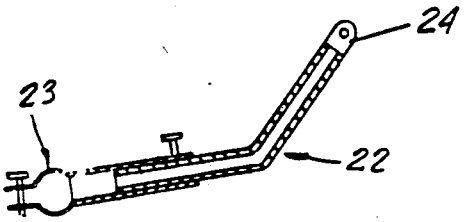
FIG. 3A is a cross-sectional view of an embodiment of a trigger pad supporting member.

Referring now to the drawings with greater particularity, shown in FIG. 1 is a portable and mobile electronic percussion music system 1 of the present invention. The portable and mobile electronic percussion music system 1 includes a plurality of various percussion trigger pads 9 held in a housing 11, a processing and control panel 7, a supporting frame 15, a player carrier harness 25 and a cymbal assembly 40.

The percussion trigger pads 9 are provided to produce different electrical percussion signals representing significant music notes responsive to strikings of a player by use of drumsticks. In each of the trigger pads 9, there is an electronic percussion transducer. The percussion trigger pads 9 may include high Tom trigger pads (HT) medium Tom trigger pads (MT), low Tom trigger pads (LT), splash trigger pads, snare trigger pads, HI-Hat trigger pads (HH), kick bass trigger pads (KK), Ride trigger pads and Splash trigger pads, etc. The trigger pads 9 are preferably arranged in a U-shaped or semi-circular pattern so that the player can easily reach each of the pads by using drumsticks and be quickly familiar with the system without need of special training. The trigger pads 9 may be arranged in two tiers as shown in FIG. 1. A Hi-Hat trigger rod 10 may be provided in front of the other trigger pads.

A U-shaped flexible housing 11 is utilized to hold the various trigger pads 9 in place. The output lines of the trigger pads 9 are routed in the housing 11 and fed out through an exit opening (not shown) with ends fixed on an electrical multi-pin connector for electrically matching with inputs of an interface on the processing and control panel 7. When more trigger pads are needed in a complicated performance, another housing 8 may be provided to hold more trigger pads which is preferably disposed in the place lower than the U-shaped housing 11 as shown in FIG. 1.

The processing and control panel 7 includes a percussion synthesizer which can comprise a MIDI-interface section, a memory section, a processing section having a microprocessor and an audio mixer, a control panel having various control buttons or keys and display elements, such as LCD for displaying operation and control status. Each input of the interface is assigned a note number or sound source. Various combinations of note numbers can be programmed into the memory banks, allowing the user to instantly access different music rhythms, such as rock, jazz, Latin, classical percussion and special sound effect setups. The interface contains parameters by which the user can manipulate trigger sensitivity, pitch accent, and decay for each input. All onboard electronic components can be powered by a rechargeable DC battery. The processing and control panel 7 preferably further includes an FM wireless transmitter which transmits the music sound signals to a receiver connected to either an amplifier or a P.A. system. This will be very useful, especially when a performance is held in the streets or similar places. Of course, as an alternative, the processing and control panel 7 may be directly coupled to an amplifier or a loudspeaker via an electrical cable. Further, in an uncomplicated performance, the processing and control panel 7 may stay stationary, and communication between the panel 7 and trigger pads 9 can be provided through a cable line. It should be understood that the detailed circuitry arrangement of a synthesizer and the interconnections of electronic elements are known to those skilled in the art and depend upon what functions are desired.

The housing supporting frame 15 is provided to support the housings 11 and 8, and the processing and control panel 7. An embodiment of the housing supporting frame 15 is shown in FIG. 2. FIGS. 2A and 2B show, respectively, a top view and a side view of the housing supporting frame 15 which is formed by horizontal and vertical bars or tubes 16, 18 and 19. The horizontal bars or tubes 18 includes connection portions 21. Each of the connection portions 21 has an aperture with a diameter the same as the outer diameter of the vertical bars or tubes 16 for a complementary engagement. On each of the connection portions 21 is provided an adjustment element 17, such as a thumbscrew lock for locking the vertical bar or tube 16 in the aperture of the connection portion 21 and adjusting the height of the supporting frame 15 when it is necessary. An adjustment element 17 is also provided at the end of each vertical bar or tube 16 for locking and adjusting the cooperative engagement between the vertical bars or tubes 16 and connection elements at the bottoms of the housings 11 and 8. Instead of using the complementary type of engagement, a small round or square plate 19 may be arranged at the end of bars or tubes 16 with two or more small holes therethrough so that screws can be used to mount the housing 16 on the bars or tubes 16, as exemplarily shown in FIGS. 2A and 2B. The bars or tubes used in the supporting frame 15 may be made of aluminium or plastic materials or other light materials. The supporting frame 15 has two connection parts 20 which are provided for connection with the player carrier harness 25.

The player carrier harness 25 preferably includes a waist portion 27 and a shoulder portion 35. The waist portion 27 is provided with a pair of tubes 26 and a pair of tubes 31 with inner diameters larger than the diameters of the connection parts 20 of the supporting frame 15 and the bars or tubes 34 of the shoulder portion 35, respectively, so that the shoulder portions 35 and the supporting frame 15 can be cooperatively connected with and separated from the waist portion 27. The adjustment screw locks or knobs 32 are designed at the tube ends for locking the connections and providing an access for adjusting the distances between the shoulder portions 35 and the waist portion 27, and between the waist portion 27 and the supporting frame 15. It should be understood that some other suitable and adjustable connection methods and adjustment methods may also be utilized in the present invention as long as they satisfy the requirements disclosed by the present invention. A battery pack 30 may be attached to the back surface of a hip saddle 28, fixed on the tubes 26 for evenly distributing the weight over the hips, in cases where a power supply cable is not used or not available. The hip saddle 28 has a front belt portion with a buckle thereon for fastening the saddle 28 on the player's waist. The shoulder portion 35 comprises a shoulder pad and a pair of arm straps 33.

The shoulder portion 35 may further comprise a connection tube 37 for selectively holding a cymbal assembly 40 extending upwardly above the player's head. The cymbal assembly 40 can include a bent thinner tube 38 adjustably connected to the tube 37 and a cymbal frame 39 adjustably engaged with tube 38, on which a plurality of electronic cymbal triggers or conventional cymbals are mounted. In this configuration, the height and distance of the cymbal triggers from the player's head is changeable. A headrest pad 36 may be arranged on the shoulder portion 35 so as to make the player more comfortable during play.

Figure 3B:
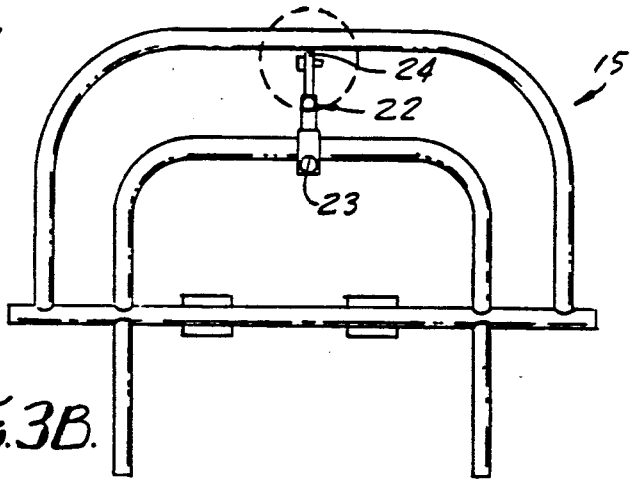
FIG. 3B is a top view of a supporting frame and a pad supporting member locked on the supporting frame.

In another preferred embodiment, the various trigger pads are not arranged in a housing. Instead, each of the trigger pads can be separately positioned at different heights and positions, according to the habits of a player. Each trigger pad can be adjustably supported by a supporting member which is connectable to the supporting frame 15 or integrally formed with the frame 15. A supporting member is shown as an example, by FIG. 3A and may include two tubes 22 in a telescoping relation, an adjustment for adjusting the height of the telescoping tube, and a connection portion 23 for connection to the supporting frame 15, wherein one of the tubes has a bent portion and the connection portion 23 is a clamp for locking the supporting member on a supporting frame 15 by a bolt or other means. In this arrangement, the supporting frame 15 may be simplified as exemplarily shown by FIG. 3B. At the bottom of each of the trigger pads may be further provided a ball bearing configuration for adjusting the angle of the surface of each trigger pad with respect to the player. This angle may also be adjusted through the connection between a supporting member and a supporting frame. A simple example of such connection is to provide two small pieces of material 24 with a bolt aperture separately and integrally formed at the top end of a supporting member, and another small piece of material with a bolt aperture arranged at the bottom of a trigger pad and being fastened between the two pieces of material 24 on the supporting member by a bolt or screw so that the angle of the trigger pad is adjustable during connection. Of course, the previously discussed trigger pad housing may also be supported by the same supporting frame 15.

Figure 4:
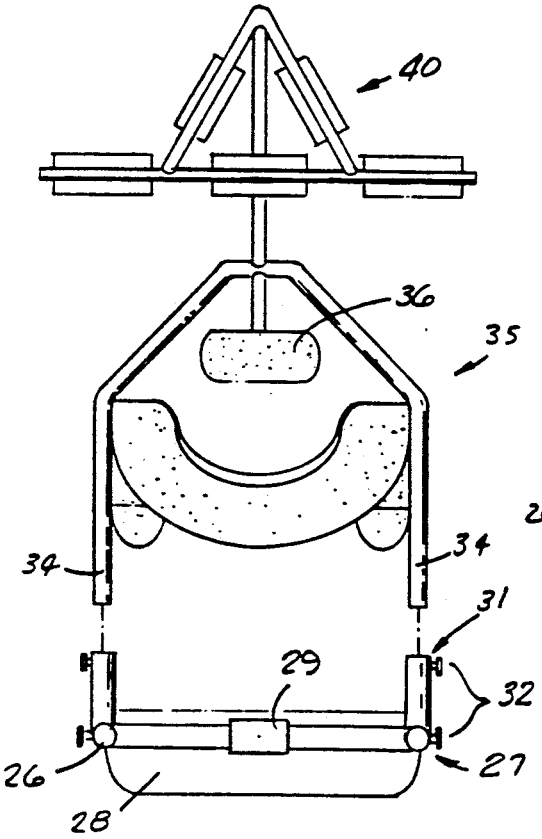
FIG. 4 shows an embodiment of the player carrier harness of the present invention, including a shoulder portion with an electronic cymbal assembly thereon and a waist portion.
Figure 5:
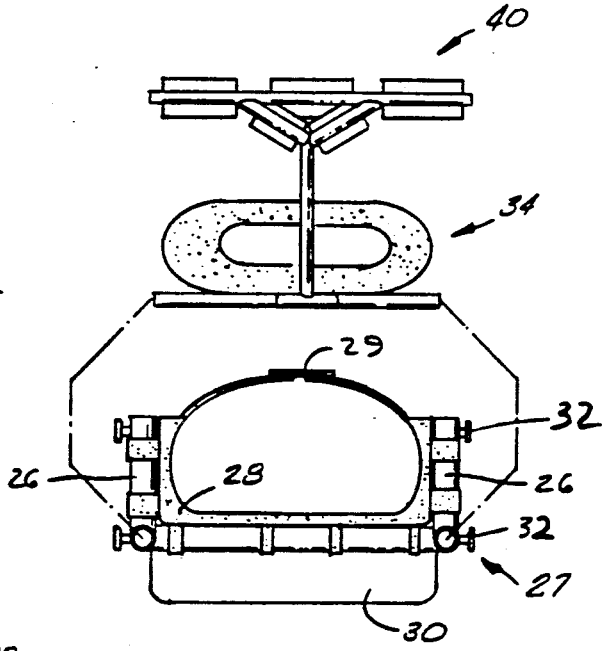
FIG. 5 is a top view of the waist portion and the shoulder portion with a cymbal assembly shown in FIG. 4.
Figure 6:
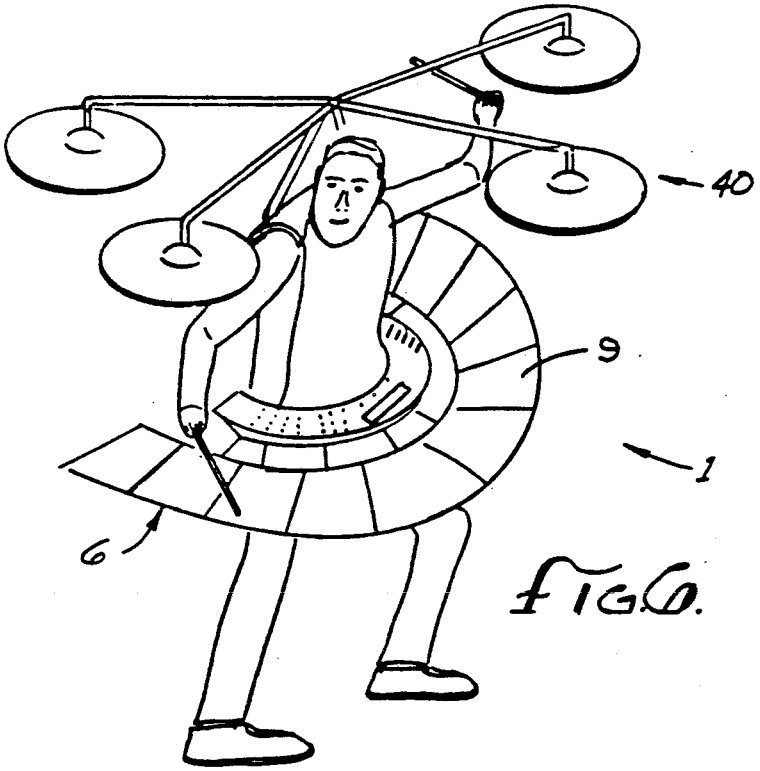
FIG. 6 is a perspective view of another embodiment of the portable and mobile electronic percussion music system of the present invention.

FIG. 4 shows another embodiment of a shoulder portion 34 and the cymbal assembly 40 which are integrally connected to each other. FIG. 5 is a top view of the cymbal assembly 40 and the waist portion 27 shown in FIG. 4. Turning now to FIG. 6, FIG. 6 shows another embodiment of the electronic percussion music system 1 of the present invention, wherein conventional acoustic cymbals are used to add additional music and visual effects for performance and all the percussion trigger pads 9 are arranged in two tiers and are held in a single U-shaped housing 6.

Figure 7:
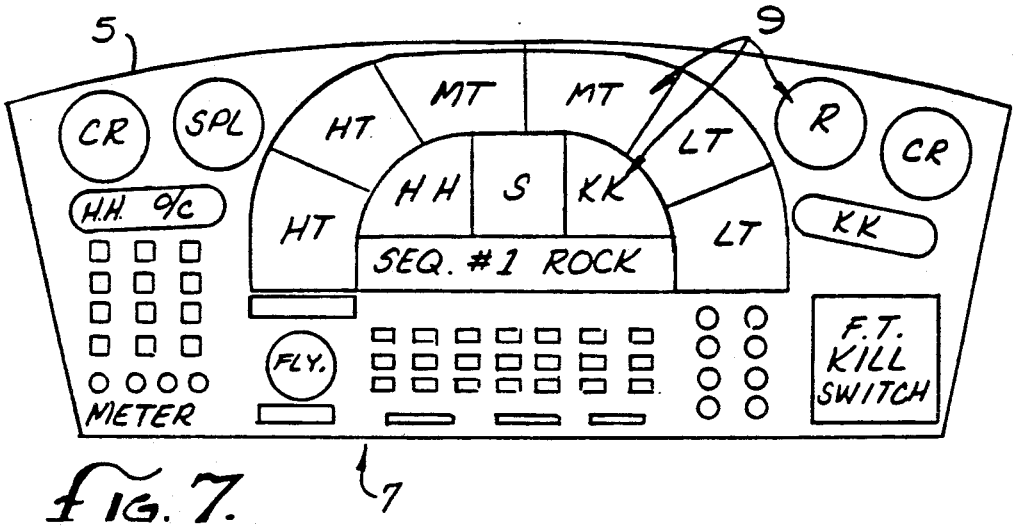
FIG. 7 schematically shows another arrangement of the percussion trigger pads and the processing and control panel which can be held in a single housing.

In one embodiment of the present invention, as shown in FIG. 7, all percussion trigger pads 9, the processing and control panel 7 and all other electronic components can be arranged in a single, compact housing 5.

Figure 8:
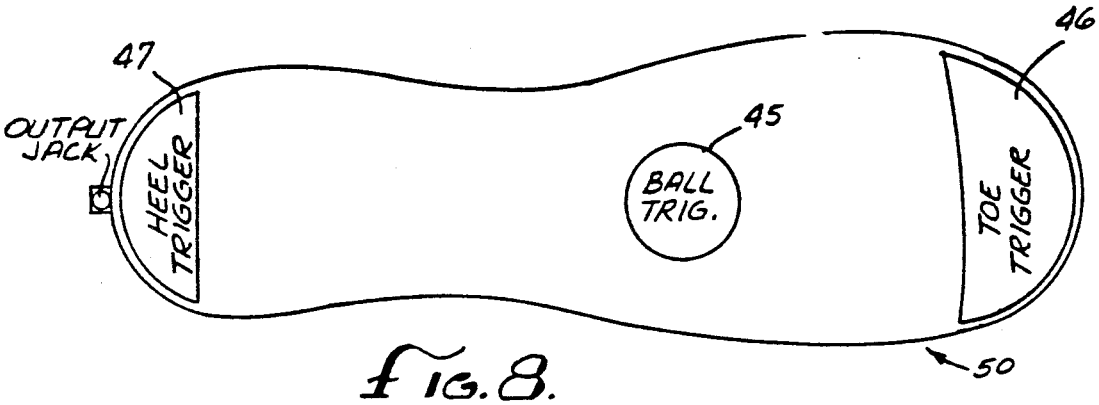
FIG. 8 schematically show different arrangements of foot triggers fastened on the shoes of a performer.

In addition, foot triggers may be embedded in the soles of shoes or attached to the shoes worn by the performer for greater functionability and a more natural feel, while maintaining the system as entirely mobile. Various triggers can be arranged at different positions in a shoe 50, as shown by FIG. 8, such as one trigger at the heel portion 47, another trigger at the ball portion 45, and still another trigger at the toe portion 46. A signal transmitter or an output jack 48 are provided on the shoe for transferring the trigger signals. The triggers at different positions in a shoe may be triggered in a different manner. For example, the trigger at the ball portion may be triggered while the shoe is lifted from the ground, and the trigger at the toe portion may be triggered while this portion touches the ground. The triggers may be provided in both the left shoe and the right shoe. The foot triggers can be used in cooperation with other triggers supported on the frame 15 to produce special music sounds. The trigger signals from the shoes may be cut off by some switches on the control panel or an air-pressure type of switch 42, such as a microphone fastened on the shoulder portion of a player carrier harness and activated by the voice of the player to send an electrical switch trigger signal. This switch trigger may also be used to control other electronic components or sections.

With the structure of the electronic percussion music system of the present invention, the performer or player need no longer remain stationary and may now become an integral element of performance choreography. The system can also be easily separated into parts so that it is convenient for transportation. Furthermore, the present invention provides many position adjustment elements in the system to allow many players with different height and arm lengths to comfortably use this music system in a moving performance.

While the preferred examples of the present invention have been shown and described, it should be apparent to those skilled in the art that many more modifications are possible without departing from the invention concept herein disclosed. It is intended to cover in the appended claims all such modifications as fall within the true spirit and scope of the invention.

What is claimed is:

1. A portable and mobile electronic percussion music system, comprising:

a plurality of percussion trigger means for producing trigger signals responsive to strikings of a performer, housing means for holding said percussion trigger means in place, a supporting frame means for supporting said housing means, a performer carrier means separably connected with said supporting frame means for carrying said supporting means, and a cymbal assembly extended upwardly above the performer's head and secured on said performer carrier means.

2. A portable and mobile electronic percussion music system in accordance with claim 1, wherein said percussion trigger means includes a variety of electronic drums.

3. A portable and mobile electronic percussion music system in accordance with claim 1, further including a processing and control panel means for ,processing said trigger and producing sound output representing said trigger signals, said processing and control panel means including a percussion synthesizer.

4. A portable and mobile electronic percussion music system in accordance with claim 1, wherein said housing means includes an upper pad rack for holding a plurality of said percussion trigger means, and a lower pad rack for further holding a tier of said percussion trigger means, at least one of said pad racks being extended approximately in an "U-Shape."

5. A portable and mobile electronic percussion music system in accordance with claim 3, wherein said housing means further contains said processing and control panel means.

6. A portable and mobile electronic percussion music system in accordance with claim 1, wherein said supporting frame means is formed by a plurality of horizontal and vertical rods which are connected to each other in such a way that they are separable for transportation.

7. A portable and mobile electronic percussion music system in accordance with claim 1 or 6, wherein said supporting frame means includes adjustment means for adjusting the height or length of said supporting frame means.

8. A portable and mobile electronic percussion music system in accordance with claim 1, wherein said performer carrier means includes a shoulder portion connected to a waist portion with a connection means for cooperative engagement with said supporting frame means.

9. A portable and mobile electronic percussion music system in accordance with claim 8, wherein said shoulder portion and said waist portion are separably connected to each other, and the distance between said shoulder portion and said waist portion is adjustable.

10. A portable and mobile electronic percussion music system in accordance with claim 1, wherein said cymbal assembly includes a plurality of cymbals.

11. A portable and mobile electronic percussion music system in accordance with claim 1, wherein said cymbal assembly is separable from said performer carrier means and the position of said cymbal assembly with respect to the performer is adjustable.

12. A portable and mobile electronic percussion music system in accordance with claim 1, further including a separation Hi-Hat percussion trigger rod independently disposed in front of said housing means.

13. A portable and mobile electronic percussion music system in accordance with claim 1, further including foot percussion trigger means fastened on at least one portion in the bottom of at least one shoe of the performer for producing special trigger signals in response to actions of performer's feet.

14. A portable and mobile electronic percussion music system, comprising:

a plurality of percussion trigger means for producing trigger signals responsive to strikings of a performer, a processing and control means for processing said percussion trigger signal sand producing sound signals representing said trigger signals or processed rhythms, a housing means including at least one approximate U-shaped pad rack for holding said percussion trigger means in place, a supporting frame means for supporting said processing and control means and said housing means, said supporting frame means being adjustable in such a way that the relative position of said housing means with respect to the performer is changeably, a performer carrier means including a shoulder portion and a waist portion which are separably and adjustably engaged to each other for carrying said supporting frame means through a separable and adjustable connection with said supporting frame means.

15. A portable and mobile electronic percussion music system in accordance with claim 14, wherein said processing and control means includes a percussion synthesizer, which includes a MIDI interface for signal input, a control panel with various control keys for allowing performer to directly interact with the processing of said trigger signals and display means for displaying operation and control status of said synthesizer.

16. A portable and mobile electronic percussion music system in accordance with claim 14, wherein said processing and control means includes an FM wireless transmitter means for transmitting signals representing said trigger signals to a receiver coupled to a sound amplifier or circuit.

17. A portable and mobile electronic percussion music system in accordance with claim 14, wherein said housing means and said supporting frame means respectively includes a connection means for connection to each other.

18. A portable and mobile electronic percussion music system in accordance with claim 14, further including a cymbal assembly disposed above the player's head and supported by a cymbal frame means separably and adjustably fastened on said shoulder portion.

19. A portable and mobile electronic percussion music system in accordance with claim 14, wherein said waist portion of said performer carrier means includes a hip saddle means with a front belt for mounting said waist portion on the performer's waist and evenly distributing weight over the performer's hips.

20. A portable and mobile electronic percussion music system in accordance with claim 14, wherein said shoulder portion and waist portion of said performer carrier means are separable and adjustable so that it is portable and suitable for various performers.

21. A portable and mobile electronic percussion music system, comprising:

a plurality of electronic trigger means for producing trigger signals responsive to striking of the player, processing and control means for processing trigger signals and producing sound signals representing said trigger signals, supporting frame means for adjustably supporting said trigger means and said processing and control means, a player carrier means being connectable to said supporting frame means for carrying said supporting frame means, and a cymbal assembly being adjustably connected to said player carrier means.

22. A portable and mobile electronic percussion music system in accordance with claim 21, further including a housing means for holding said processing and control means and said trigger means.

23. A portable and mobile electronic percussion music system in accordance with claim 22, wherein said housing means includes at least a U-shaped pad rack for holding said percussion trigger means in place.

24. A portable and mobile electronic percussion music system in accordance with claim 21, wherein said player carrier means includes a shoulder portion and a waist portion which are separably and adjustably engaged to each other.

25. A portable and mobile electronic percussion music system, comprising:

a plurality of percussion trigger means for producing trigger signals, a supporting frame means for supporting said trigger means, a player carrier means separably connected to said supporting frame means for carrying said supporting means, and a plurality of trigger supporting means respectively connected to one of said plurality of trigger means and to said supporting frame means for adjustably supporting each individual trigger means in such a way that the distance and height of each of said plurality of trigger means with respect to a player can be individually adjusted to desired position according to the requirements of the player.

26. A portable and mobile electronic percussion music system in accordance with claim 25, further including a processing and control means for processing trigger signals and producing sound signals which can be mounted on said supporting frame means.

27. A portable and mobile electronic percussion music system in accordance with claim 25, further including a cymbal assembly which can be adjustably connected to said player carrier means.

28. A portable and mobile electronic percussion music system in accordance with claim 25 further including foot percussion trigger means fastened on at least one portion in the bottom of at least one shoe of the performer for producing special trigger signals in response to the actions of performer's feet.

* * * * *